United States Patent [19]

Postupack

[11] Patent Number: 4,646,555

[45] Date of Patent: Mar. 3, 1987

[54] DUAL STAGE PRESS

[76] Inventor: Andrew Postupack, 105 Randon La., Hazleton, Pa. 18201

[21] Appl. No.: 705,898

[22] Filed: Feb. 26, 1985

[51] Int. Cl.[4] ..... B21J 9/18

[52] U.S. Cl. ..... 72/453.03; 72/453.09; 100/271; 100/292

[58] Field of Search ..... 72/452, 453.02, 453.03, 72/453.04, 453.06, 453.09; 100/238, 270, 271, 291, 292

[56] References Cited

U.S. PATENT DOCUMENTS 3,122,033 2/1964 Riemenschneider et al. ..... 100/291

3,743,469 7/1973 Gibbons ..... 100/291

FOREIGN PATENT DOCUMENTS 1186369 4/1970 United Kingdom ..... 72/453.03

*Primary Examiner*—Lowell A. Larson
*Assistant Examiner*—David B. Jones
*Attorney, Agent, or Firm*—Anthony J. Dixon

[57] ABSTRACT

A two stage press comprising a first and second power cylinder, a cam activated by power cylinder, and a base plate for material to be worked wherein a tool can be brought into contact with material at very high pressures, particularly applicable in solderless crimping applications.

3 Claims, 5 Drawing Figures

DUAL STAGE PRESS

BACKGROUND OF THE INVENTION

1. Field of the Invention

The present invention relates to an apparatus for forming, blanking, crimping and the like in the general field of forming material.

More particularly, the present invention relates to an apparatus for forming material under force such as is done with a press.

More particularly, the present invention relates to a pneumatic two-stage press which provides high force treatment of materials while providing safety to operators, ease of control and interchangeability of tools.

2. The Prior Art

The field of power presses and material treatment devices is an old one. Many types of apparatus have been fashioned to form or treat materials to either blank, form, pierce, stake, shear, assemble, fasten or crimp it.

An example of the type of apparatus in this field can be seen in U.S. Pat. No. 1,813,040 issued to W. Ferris et al. This patent discloses an automatic control of hydraulic transmission mechanics for use primarily in presses and the like. It discloses a variable displacement mechanism for driving an element through successive stages of an operating cycle yet a high force two-stage mechanism of the present invention is neither disclosed nor contemplated.

U.S. Pat. No. 1,765,762, issued to J. C. Harris discloses a die press or drawing press for embossing, coining and the like. An increasing pressure step is disclosed but it is well short of an actual two-stage operation as will be disclosed herein especially considering the crimping requirements which are addressed by applicant's invention.

U.S. Pat. No. 2,169,036 issued to E. M. Bidwell relates to a material working apparatus which utilize high pressure to compress a set of dies together by hydraulically supplied force. A cam mechanism is used to complete the cycle and raises the plunger to its original position; however, it only discloses a continual one stage mechanism. Further the types of pressure needed in today's highly sophicticated crimping procedure would be unachievable by the Bidwell press. These shortfalls are met by the present invention, a summary of which follows.

SUMMARY OF THE INVENTION

It is therefore an object of the present invention to overcome the short falls evident in the art and provide a two-stage press which generates sufficient force at the tool to achieve the necessary result while providing safety, predictability and ease of interchange of tools.

It is a further object of the present invention to provide a dual stage vertical press which can provide a series of operations such as blanking, forming, piercing, staking, shearing, assembling, fastening and the like.

It is a further object of the present invention to provide a dual stage press which, in addition to the above, is especially suited to solderless wire terminal crimping.

It is a further object of the present invention to provide a versatile dual stage press apparatus whcih can be manufactured in a low volume, customized fashion while providing specifically set forth and dedicated requirements. These, and other objects and advantages are met by the apparatus of the present invention which comprises:

a. horizontal base tooling plate;
b. a pair of opposing vertical side plates mounted on said tooling plate;
c. a stabilizing bar fastened to each side plate and to the underside of said base tooling plate;
d. a pair of ram plates slidingly mounted to said side plate; said ram plates extending through the plane of the base tooling plate;
e. a pair of linear bearings interposed between said ram plates and said side plates;
f. means for holding a tool fixedly mounted to said ram plates in a plane parallel to the plane of the base tooling plate;
g. a connector bar spanning said ram plates at a location below said base tooling plate;
h. a first pneumatic power means;
i. a second pneumatic power means which can provide force higher than said first power means;
j. a cam mounted on the underside of said base plate actuated upon downward movement of the ram plate assembly to a given completion position; thereby actuating said second power means and returning said cam assembly to its initial position upon completion of its oscillation.

It is envisioned that the power will be supplied by a first low force air cylinder and a second high force cylinder to power the downward ram movement and cam actuation respectively.

The invention will be better understood and appreciated, however, upon review of the drawings and the description of the preferred embodiment which follows.

THE PREFERRED EMBODIMENT

Figure 1:
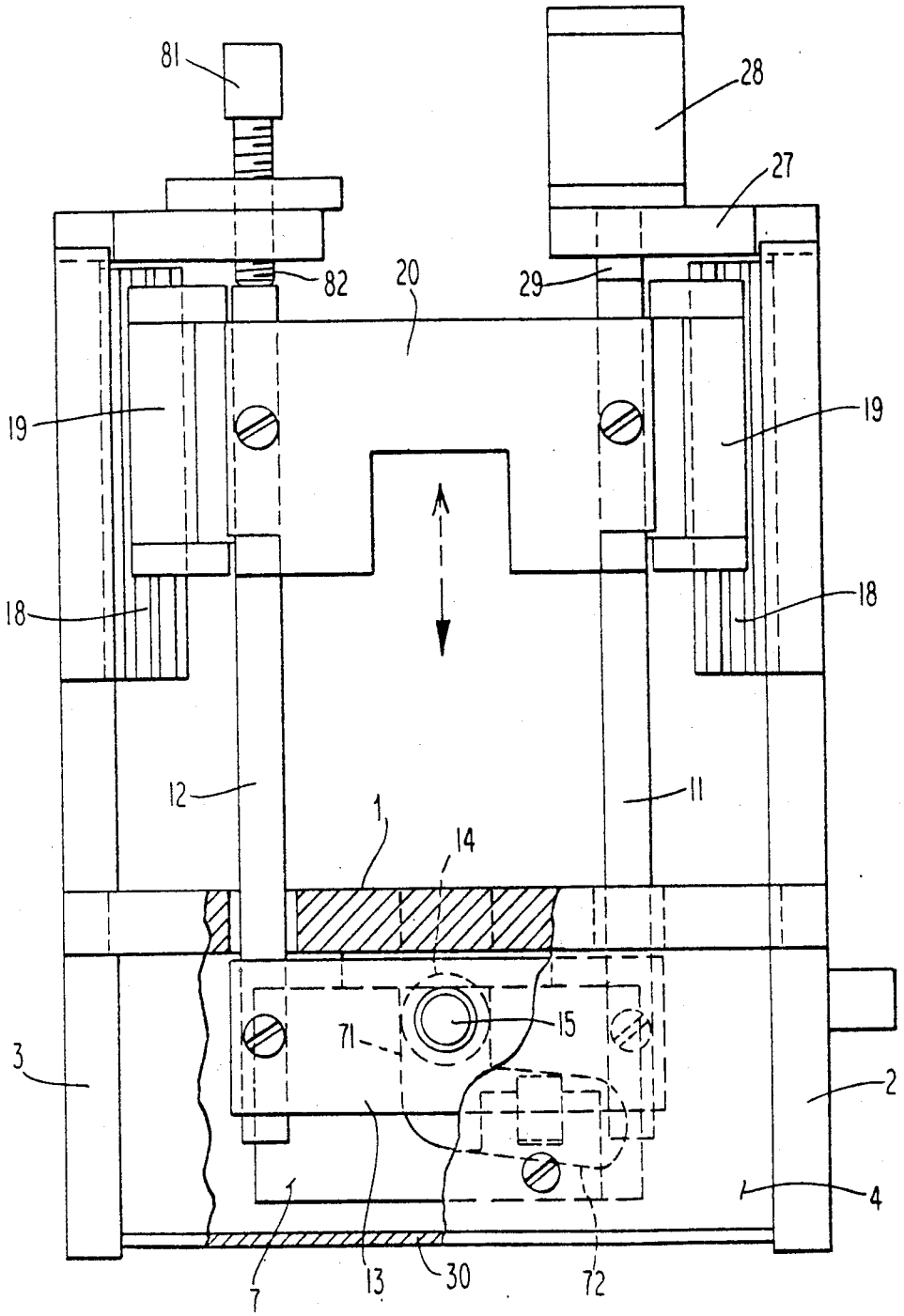
FIG. 1 is a front sectional view of the apparatus of the present invention.
Figure 5:
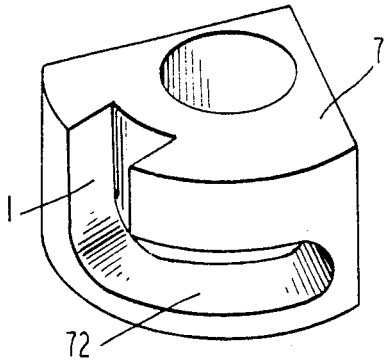
FIG. 5 is a view of Cam 7 with track 71 and 72.
Figure 2:
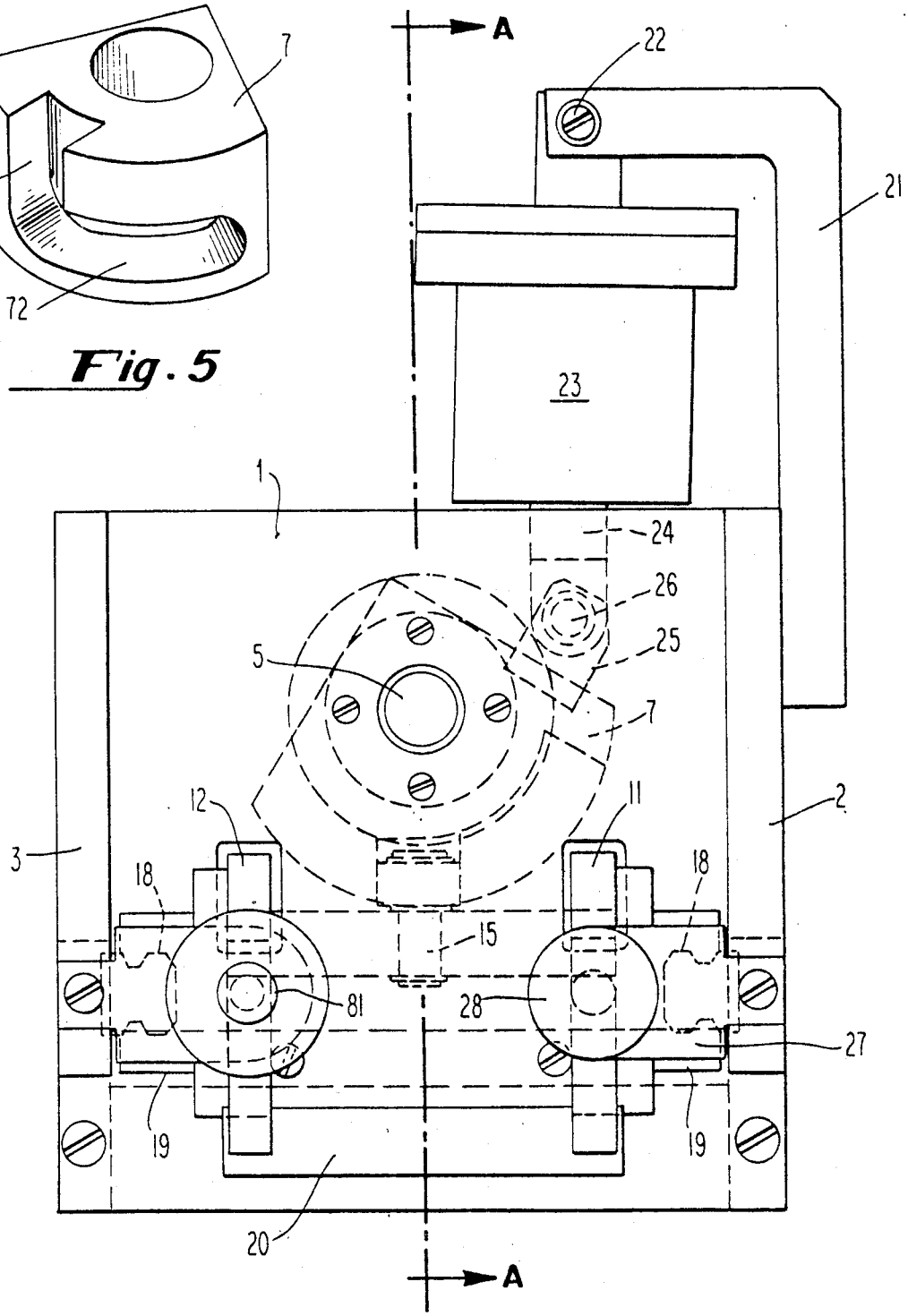
FIG. 2 is a side sectional view of the present apparatus.

With reference initially to FIG. 1 and FIG. 2, the operation of the apparatus, of the present invention can be described.

Figure 4:
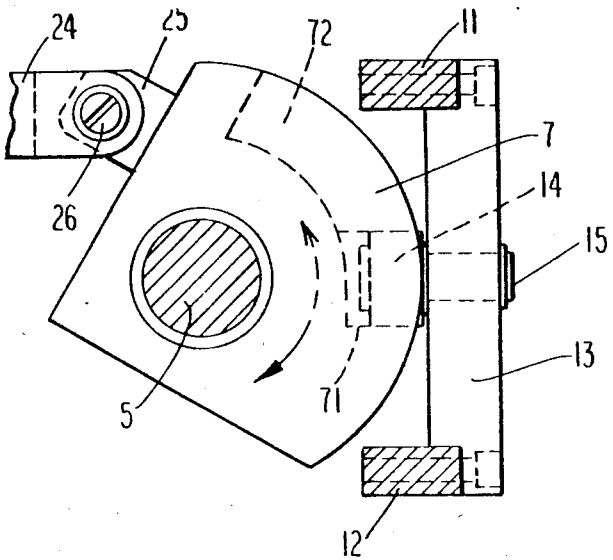
FIG. 4 is a view of Cam 7 as it interacts with cam drive and follower.

Initially, the basic structural elements of the apparatus will be reviewed. The apparatus is centered around a base tooling plate, 1, which is a solid horizontal member. Two vertical structural members, side plates 2 and 3 are fixedly mounted to said base tooling plate 1. This connection is strengthed by a horizontal stabilizing bar, 4 which runs underneath the base tooling plate 1 and is fastened on each end to side plates 2 and 3 respectively. All of the structural members are machined from high strength alloy steel plate. The purpose of the particular configuration adequately withstands heavy moment loads in the apparatus with mininal deflection. Bottom plate 30 completes the structure. See FIG. 4.

The basic operation member of the present invention is the dynamic ram of the press which is comprised of a number of elements.

This member is comprised of two ram plates, 11 and 12 which are perpendicular to the base tooling plate and connected below it by a hardened steel bar 13. Spanning said plates is a tool holder 20 which is in a plane parallel to the plane of base plate 1. Mounted centrally on bar 13, is cam follower 14 which will be described later.

The entire ram assembly is slidingly connected to structural members 2 and 3. Interposed thereon are bearings 19 which are anti-friction linear bearings of the ball or roller type. The bearings are preloaded for zero clearance. Bearings of this sort are used herein to allow the present press apparatus to function with the precision of a die set so as to meet the requirements especially prevalent in today's solderless crimping application. Also it should be noted that such bearings are able to handle exceedingly high load capacity to size ratios and have very high moment capacities.

Many bearings are researched for suitability in the apparatus of the present invention. The present sizings are suitable for press outputs of 4000 pounds and provide accuracy, long life and load carrying capabilities in the present application.

These bearings are mounted in track way 18 and are as shown on FIG. 1, allowing the entire dynamic ram of the press consisting of elements 11, 12, 20 and 13 to move through the cycle of the apparatus. Normally, presses are powered by motor driven flywheels connected to eccentric cranks or toggles, hydraulically or pneumatically powered cylinders and mechanical linkage. The drawback is that the power transmission is at its maximum through the full length of the cycle or stroke. This is an unnecessary and hazardous method since the force is usually only needed at the bottom or end of the stroke. The structure of the present invention overcomes this drawback by its two stage operation to allow exceedingly high force at cycle completion without such force throughout the stroke. This not only allows higher force of operation, but provides safety to the operator.

Figure 3:
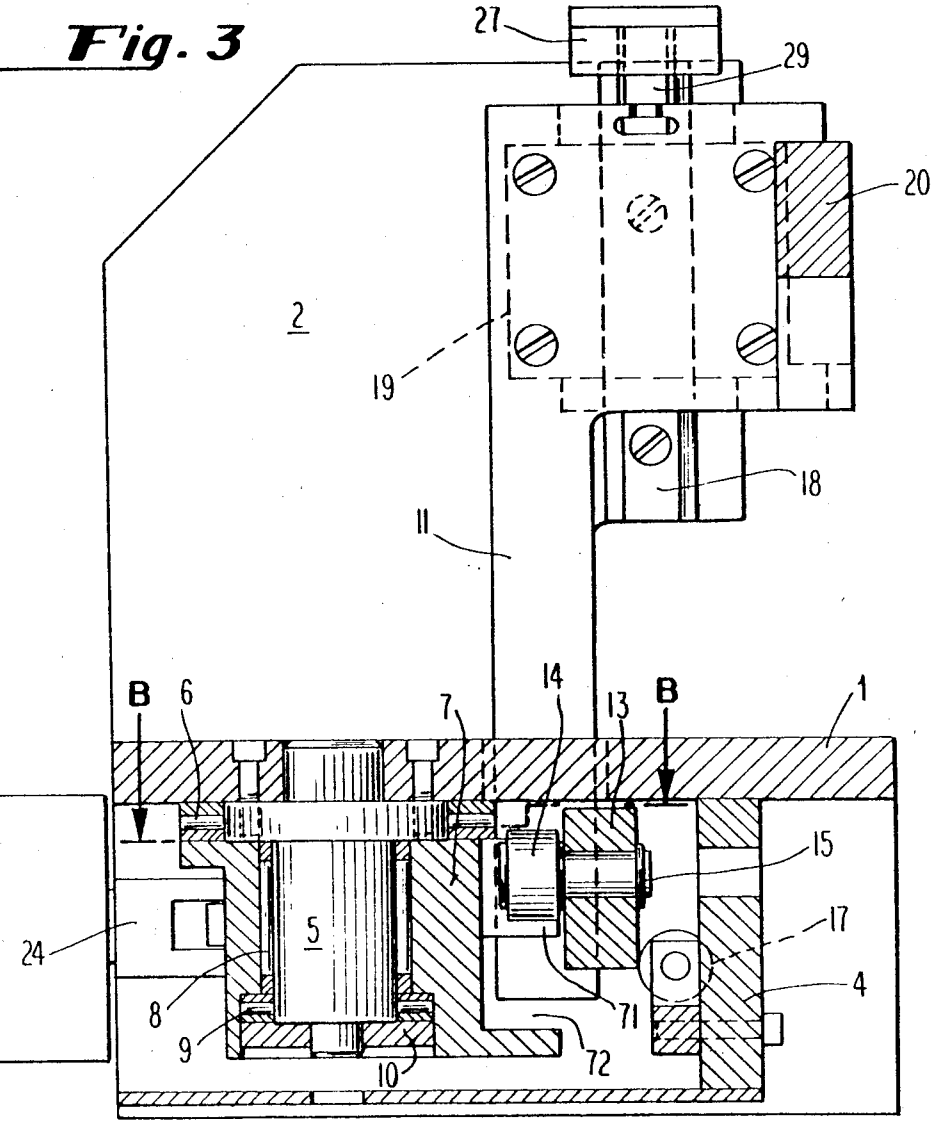
FIG. 3 is a sectional view along lines A—A of FIG. 2.

The operation of the present invention begins with the ram at the position shown in FIGS. 1 and 3.

The ram assembly is driven in two steps. The first step is powered by a small bore air cylinder 28 which is a low force system usually about seventy (70) pounds. It is mounted via mount 27. This drives rod 29 and thereby the ram assembly downward to a given location, in this case, to a location which brings tool holder 20 to a position of about one inch above base plate 1. Cam 7 is mounted underneath plate 1 as best shown in FIGS. 1 and 2. It pivots around stationary shaft 5, which moves via thrust bearing 6, roller bearing 8 and thrust bearing 9. These bearings are sized to withstand the force generated by the large bore air cylinder 23. The cam 7 is a barrel type with an axis at ninety degrees (90°) to the dynamic ram assembly. Cam follower 14 and stud 15, mounted on actuator bar 13 moves as actuated by the oscillation of cam 7. It follows track 72 provided in the structure. End cap 10 completes this structural aspect of the apparatus. Note that cam 7 has defined therein track 71 and 72 through which cam follower 14 travels. The cam is powered via cylinder 23 (see linkage 24, 25 and 26 in FIG. 4) causing the ram assembly to move as actuator bar 13 and ram plates 11 and 12 move.

When this cam follower reaches the bottom of its track, due to downward movement of the ram assembly, the cam, powered by high force, large bore, air cylinder 23, mounted on brackets 21 and 22, oscillates and drives the ram downward to the bottom of the cycle thereby engaging a tool, not shown, mounted in tool holder 20 with the material upon which it is to operate. The rod 24 connects cylinder 23 to the cam. Reconnection is via bracket 25 and trunnion pin 26 as shown. The force at the end of the stroke is ten (10) times that of the cylinder thrust due to the mechanical advantage of the cam in its displacement curve. A completion of the cam oscillation returns the cam to the beginning of the high force cycle. At this point, a clearance groove 71, in the cam 7 aligns with actuator bar Guide 17 to allow the ram assembly to be lifted to its initial position.

Structurally, the cam 7 and the air supply 23 which drives it are located beneath its base tooling plate 1 so as to maintain the top surface of plate 1 free of obstructions and to maximize the available area for tooling and mechanism. The known presses have this located above the main plate which lends to congestion and less free operating by operators. This also vastly simplifies the addition of feeding systems for high volume which since these systems can be installed to feed right to left, left to right, back to front and vice versa without interupting the power transmission aspects of the apparatus.

An important safety feature is synergistically added to the press apparatus by introduction of the two-step process of the present invention. Since the ram assembly, comprised of plates 11 and 12, bar 13 and tool holder 20 moves at low force until the end of the cycle, a minor obstruction will stall the mechanism. When the ram assembly reaches the high pressure phase, the clearance is so small that obstruction potential is severely limited. This inures to the benefit of the operator, particularly to his hands and fingers. The stroke can be adjusted as follows, to meet specific application and tooling requirements.

A screw type adjustment with knob 81 and stop 82 are provided to stop the ram upstroke. Further, the separation of the cylce into low force and high force components increases the types of feed system logic which can be included in the system in operations. For example, a part that is to be formed, assembled or crimped can move to a forward position during the low force step and fed in to be treated in the high force step. The system can be signalled to reset upon return of the high force cam to its initial position.

The force comtemplated in the present invention is anticipated to be compressed air and the sequency to be controlled by electronic programmable controller. These systems are known in the art and are not shown herein in order to simplfy the drawings and enhance the explanation of the operation of the invention. For example, in the preferred embodiment, as the low force cylinder 28 extends via rod 24, the ram advances to a point until it is stopped by cam 7. At that point, the high force cylinder and thereby cam follower 14 and guide 17 to complete the ram assembly movement and engage the tool holder 20 and tool to the end of the stroke. At the stroke end, a signal causes low force cylinder to retract to start a new sequence.

Other operations such as feed systems, clamps, work positioning devices and the like can operate from an output signal from the ram assembly stroke.

As a result, a highly versatile apparatus is provided which can be used in a wide variety of applications.

One example is in the solderless crimping of wire connectors as so widely used in electronic systems today. A test run of the apparatus reacted as follows:

Using a load of 2,800 pounds, a series of 1,000,000 cycles of the device were run at 75 cycles per minute. No appreciable wear and tear were found either in the structure or the control mechanisms and logic. The total stroke was 1 3/16 inch with 0.200 inch of the stroke being under heavy work load of 2,800 pounds. A low force was at 85 psi using compressed air.

Naturally, various modifications can be made without departing from the scope of the invention as disclosed herein.

I claim:

1. A dual stage press apparatus for working material wherein a tool is moved from a first position to an intermediate position and to an engagement position with the workpiece comprising:

(a) a horizontal base tooling plate;
(b) a pair of opposing vertical side plates mounted on said base tooling plate;
(c) means for stabilizing said side plates;
(d) a pair of ram plates slidingly mounted to said side plates;
(e) antifriction linear bearings interposed between said side plates and said ram plates;
(f) A tool holder fixedly mounted to said ram plates and in a plane parallel to the plane of the base tooling plate;
(g) means for releasingly mounting tools to said tool holder;
(h) horizontal means for connecting the ram plates at a location below the base tooling plate;
(i) a first air cylinder attached to said pair of ram plates;
(j) a second air cylinder mounted beneath said tooling plate which can provide power in excess of said first pneumatic power means;
(k) means for activating said first power means;
(l) means for activating said second power means at said intermediate position of the tool holder;
(m) means for translating the power of said second air cylinder to said tool holder comprising;
  (a) a cam mounted on the underside of said horizontal base tooling plate;
  (b) an l-shaped trackway definded in the face of said cam;
  (c) a cam follower which travels in said trackway;
  (d) means for connecting said cam follower to said horizontal connecting means; whereby oscillation of said cam results in movement of the cam follower in said track causing a downward movement of said horizontal connecting means, ram plates and tool holder a distance equal to the movement of the cam follower in said track.
(n) means for returning said tool holder to its first position;
(o) means for adjusting the length from the first position to the engagement position and
(p) control means for initiating the tool movement whereby the tool is engaged and subsequently disengaged from its function on material positioned on the base tooling plate.

2. The apparatus of claim 1 wherein said cam comprises:

(a) a main body;
(b) an centrally mounted shaft;
(c) bearing means interposed between said body and shaft; and
(d) means for connecting said cam to said power means.

3. The apparatus of claim 2 wherein said tool holder has mounted therein a tool for crimping solderless wire connectors.

* * * * *